US005829393A

United States Patent [19]

Achten et al.

[11] Patent Number: 5,829,393

[45] Date of Patent: Nov. 3, 1998

[54] FREE-PISTON ENGINE

[75] Inventors: Peter Augustinus Johannes Achten, Eindhoven; Theodorus Gerhardus Potma, Kaag, both of Netherlands

[73] Assignee: Innas Free Piston, B.V., Breda, Netherlands

[21] Appl. No.: 765,703

[22] PCT Filed: Jul. 19, 1995

[86] PCT No.: PCT/NL95/00254

§ 371 Date: May 2, 1997

§ 102(e) Date: May 2, 1997

[87] PCT Pub. No.: WO96/03576

PCT Pub. Date: Feb. 8, 1996

[30] Foreign Application Priority Data

Jul. 27, 1994 [NL] Netherlands ..... 9401231

[51] Int. Cl.[6] ..... F02B 71/00

[52] U.S. Cl. ..... 123/46 A

[58] Field of Search ..... 124/46 R, 46 A

[56] References Cited

U.S. PATENT DOCUMENTS

| | | | |
|---|---|---|---|
| 4,308,720 | 1/1982 | Brandstadter | 123/46 R |
| 5,287,827 | 2/1994 | Almendinger et al. | 123/46 R |
| 5,540,194 | 7/1996 | Adams | 123/46 R |

FOREIGN PATENT DOCUMENTS

| | | |
|---|---|---|
| 7700188 | 7/1978 | Netherlands . |
| 536963 | 6/1973 | Switzerland . |
| WO 93/10342 | 3/1993 | WIPO . |
| WO 93/10345 | 5/1993 | WIPO . |

*Primary Examiner*—David A. Okonsky
*Attorney, Agent, or Firm*—Lahive & Cockfield, LLP

[57] ABSTRACT

A free-piston engine comprises a combustion part (1), a hydraulic control system (2), an energy consumption system and an engine control system. The combustion part comprises a combustion cylinder with at least one combustion piston (4). The hydraulic control system (2) comprises a hydraulic piston (24) which, together with a combustion piston (4), forms a piston assembly, and which has a first surface that, when under hydraulic pressure, exerts a force on the piston assembly (24) that is directed towards the combustion space (6) and a second surface, smaller than the first surface, that, when under hydraulic pressure, exerts a force on the piston assembly that is directed away from the combustion space. The hydraulic control system (2) further comprises a hydraulic cylinder (23) into which the hydraulic piston (9) sealingly fits, at least in the first position, a starting valve provided in a connecting channel between a first chamber, which is defined by the first surface and the hydraulic cylinder in the first position of the piston assembly, and a second chamber, which is defined by the second surface of the hydraulic piston (9) and the hydraulic cylinder (23), and a channel through which oil can flow from the pressure accumulator (14) to the second chamber, in which the first chamber can only be provided with oil in the first position via the starting valve. A return valve (19) is provided in the channel between the second chamber and the pressure accumulator (14).

4 Claims, 3 Drawing Sheets

FREE-PISTON ENGINE

The invention relates to a free-piston engine according to the preamble of claim 1.

Engines of this type are known and are used to convert chemical energy of liquid and gaseous fuel into mechanical energy, for example in the form of hydraulic or pneumatic pressure or electrical energy.

Energy conversion in known free-piston engines is accomplished by ignition of compressed air mixed with fuel in the combustion space, whereupon the expanding combustion mixture sets the combustion piston in motion. The movements of the freely moving combustion piston are controlled by the engine control system by means of a hydraulic control system. The supply of energy can be consumed by means of a hydraulic system, which may be combined with the hydraulic control system, by means of a pneumatic system or by means of an electric system.

Free-piston engines of this type, in which the chemical energy is converted into hydraulic energy, are for example known from EP 0 254 353 or WO 93/10342. In the engines described in these publications, the movements of the free piston are controlled by means of a hydraulic system, in which a hydraulic piston forming a piston assembly together with the combustion piston stands still on the outer dead centre before the start of the compression stroke, and starts a new stroke after receiving a control signal. This signal switches on a starting valve, for example valve 26 shown in FIG. 1 in EP 0254353, or valve 24 shown in FIG. 3 in WO 93/10342, whereupon the compression stroke starts.

A disadvantage of these known free-piston engines is the rebound of the piston assembly at the end of the expansion stroke. At the end of the expansion stroke, i.e. at the moment the combustion piston comes to a standstill, the pressures reigning in the first chamber and in the second chamber are the same, namely the pressure of the pressure accumulator. Since the first surface is larger than the second surface, the piston assembly will rebound and the pressure in the first chamber will quickly decrease because there is no oil supply. The pressure in the second chamber remains equal to the pressure in the pressure accumulator, so that the piston assembly will come to a standstill and subsequently move back again.

The present invention aims to reduce this rebound to a minimum so that the piston assembly can come to a standstill more quickly and less time is lost between successive strokes. As a result of this, the position of the piston assembly on the outer dead centre will also be better defined.

To this end, the free-piston engine according to the invention is designed in accordance with the characterizing part of claim 1.

By placing a non-return valve in the conduit between the pressure accumulator and the second chamber, one achieves that, during a rebound of the piston assembly, the pressure in the second chamber can become higher than that in the pressure accumulator. This high pressure acts on the second surface of the hydraulic piston and stops the movement in the direction of the combustion chamber. This way a considerable reduction of the rebound, a better control of the movement of the piston assembly and a higher frequency of the engine can be achieved.

A further improvement of the free-piston engine is achieved when the engine is designed in accordance with the characterizing part of claim 2 or 3.

By providing an open connection between the first chamber and the pressure accumulator or between the first chamber and the second chamber in the region where the piston assembly moves at a high speed, wherein said open connection can be closed by moving the hydraulic piston, the flow rates in the starting valve are kept donw, as a result of which the losses in the hydraulic system remain small.

The invention will hereinafter be further explained with reference to the drawing with the following figures.

In the figures, corresponding parts are designated by identical numerals.

Figure 1:
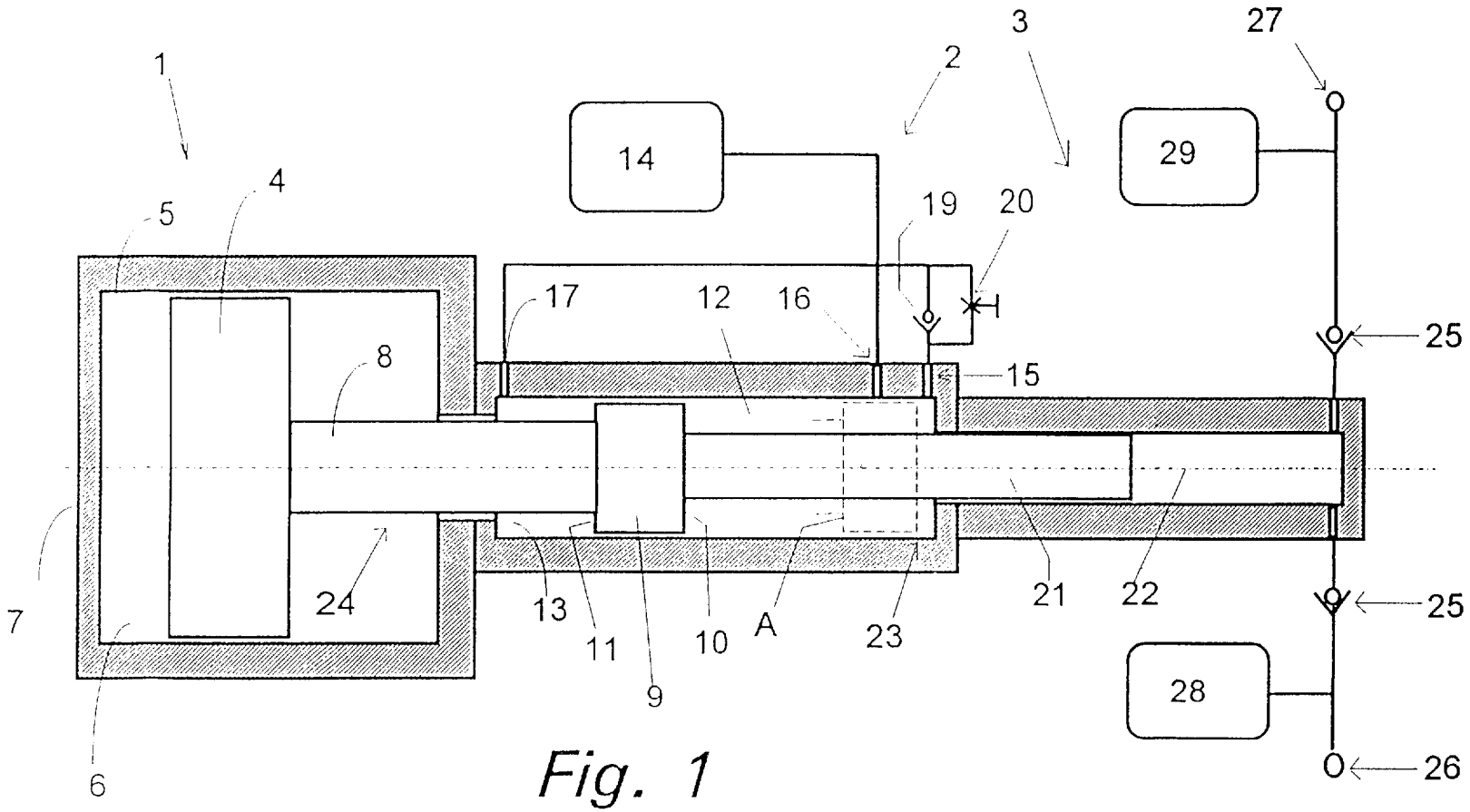
FIG. 1 shows a free-piston engine with a hydraulic control system according to the prior art.

FIG. 1 shows a free-piston engine according to the prior art, which consists of a combustion part 1, a control system 2 and a pump 3. In the combustion part 1, a combustion piston 4 is reciprocatable in a combustion cylinder 5. This combustion cylinder 5, the combustion piston 4 and a cylinder head 7 together define a combustion space 6. In the combustion space 6, fuel mixed with compressed air is ignited, whereby the chemical energy of the fuel is released in the form of gas pressure.

In the art shown here, the engine has one combustion space 6, which is defined by one combustion piston 4. Other engines are known, however, in which two combustion pistons are placed opposite each other in one cylinder, and in which the invention can be applied in a similar way.

The combustion can be accomplished in several ways, known from, for example, the field of combustion engines, more specifically that of crank-connection rod engines. An example of these is the two-stroke diesel process, in which the fuel is injected into the combustion space 6 in a way which is not further specified, when the combustion piston 4 has compressed the combustion air to the pressure and temperature required for combustion.

The compression of the air above the combustion piston 4, which is required in each internal combustion engine, is accomplished during a compression stroke. During this stroke, the combustion piston 4 moves from a first position A, in which the volume of the combustion space 6 is at a maximum, to a second position, in which the volume of the combustion space 6 is at a minimum. The first position corresponds to the position known as the outer dead centre in the art of crank-connection rod engines, and the second position corresponds to the inner dead centre. In these positions, the combustion piston 4 stands still and reverses its direction of movement. During the compression stroke, energy is supplied to the combustion piston 4 by means of hydraulic pressure, which in turn supplies this energy to the air in the combustion space 6.

The energy supply to the combustion piston 4, as well as the standstill of combustion piston 4 on the outer dead centre, are accomplished with the engine shown in FIG. 1 by means of the hydraulic control system 2, which is fixedly connected to the combustion piston 4 by means of a piston rod 8. A hydraulic piston 9 and a piston rod 21 are attached to the piston rod 8. Together they form a piston assembly 24. The hydraulic piston 9 reciprocates in a hydraulic cylinder 23. The hydraulic cylinder 23 and a first surface 10 together define a first chamber 12, which communicates with a pressure accumulator 14 via a channel 15 and a channel 16. The hydraulic cylinder 23 and a second surface 11 define a second chamber 13, which communicates with the pressure accumulator 14 via a channel 17. The first surface 10 is larger than the second surface 11. The channel 16 is closed by the hydraulic piston 9 when the combustion space 6 has approximately attained its maximum volume and the hydraulic piston 9 is in the first position A. The first chamber 12 and the pressure accumulator 14 are interconnected by the channel 15, which is connected to the right end of the hydraulic cylinder 23. This connection runs through a non-return valve 19 and a starting valve 20, which are positioned parallel to each other. The non-return valve 19 is positioned in such a way that oil can flow with little resistance from the first chamber 12 to the pressure accumulator 14. The starting valve 20 is actuated by an engine control system, not shown, which causes the engine to generate the required energy.

The operation of the engine shown in FIG. 1 and the hydraulic control system 2 is as follows: as long as the piston assembly 24 stands still on the outer dead centre, in position A, the channel 16 is closed by the outer surface of the hydraulic piston 9. The second surface 11 is subjected to the pressure reigning in the pressure accumulator 14. The starting valve 20 is closed and since the second surface 11 is smaller than the first surface 10, the pressure in the first chamber 12 is lower than that in the second chamber 13, and the non-return valve 19 is closed. The free-piston engine starts another stroke at the moment the starting valve 20 opens. Then, the piston assembly 24 starts the compression stroke. After the hydraulic piston 9 has passed the channel 16, the first chamber 12 will be filled through this channel with the oil from the pressure accumulator 14 and the second chamber 13.

The channel 16, which has a large diameter in order to allow the oil to flow with as little as resistance as possible, is positioned in such a way that the hydraulic piston 9 clears the opening of the channel 16 as soon as possible after the start of the compression stroke. When the piston is on the outer dead centre, however, a certain length must remain between the edge of the piston 9 on the side of the chamber 12 and the opening of the channel 16, so that leakage through the closure between the first chamber 12 and the pressure accumulator 14 is limited such that the piston does not unintentionally start the compression stroke. Further, the opening of the channel 16 has to remain closed during the rebound of the piston assembly 24 to be discussed hereinafter. For gap widths between the hydraulic piston 9 and the hydraulic cylinder 23 that are technically feasible and the usual accumulator pressures, a length of more than 20% of the piston diameter has been found to give good results.

During the compression stroke, energy is supplied to the piston assembly 24, which in turn supplies this energy to the air in the combustion space 6. The combustion air is introduced into the combustion space 6 by a known air supply system which is not further specified. The increasing pressure of the compressed combustion air brakes the movement of the piston assembly 24 and the piston assembly stops on the inner dead centre.

Near the inner dead centre, combustion is started by the engine control system, which corresponds to known engine control systems and is not further specified here, and which is coupled to, among other parts, the starting valve 20, a fuel system and one or more sensors measuring the energy demand of the users. Combustion is started, for example, by fuel injection or by ignition of the fuel-air mixture by a spark. The igniting mixture pushes the piston assembly 24 to the outer dead centre during an expansion stroke, i.e. the movement of the piston assembly 24 from the second position to the first position, and the energy released in the combustion process is partly stored in the pressure accumulator 14 and partly consumed via the pump 3. The piston assembly 24 comes to a standstill on the outer dead centre at the end of the expansion stroke, and due to the non-return valve closing quickly and the starting valve 20 being closed, the piston assembly 24 remains in this position until the starting valve 20 is reopened by the control means and a new stroke is started.

The starting valve 20 can be closed after the start of the compression stroke from the moment the hydraulic piston 9 clears the opening of the channel 16, and the starting valve 20 has to be closed before the moment the hydraulic piston 9 closes this opening again during the expansion stroke.

The pump 3 consists of non-return valves 25 and a piston rod 21, which defines a space 22. The pump 3 functions to create or maintain a pressure difference between a high pressure accumulator 29 and a low pressure accumulator 28. These accumulators 28 and 29 are provided with user conduits 26 and 27, which are, for example, connected to a hydrostatic engine (not shown). When this hydrostatic engine rotates and consumes energy, the pressure in the high pressure accumulator 29 decreases. This is detected by the sensors coupled to the engine control system, in response to which the engine control system actuates the engine to make a new stroke by opening the starting valve 20. The control system further, among other functions, serves to supply the fuel required for a certain energy consumption to the combustion space and to cause the ignition to take place in time.

The pressure in the high pressure accumulator 29 is determined by the consumption; this pressure can be very low or, on the contrary, incidentally or over prolonged periods very high. The pressure in the pressure accumulator 14 is maintained as much as possible at a constant level, so that the engine control system can operate optimally.

Besides the control means described hereinbefore, other known auxiliary systems are provided, such as the system that takes the piston assembly to the outer dead centre if no ignition has taken place at the end of the compression stroke, and an oil suppletion system, which functions to maintain the pressure in the pressure accumulator 14 at the desired level.

The free-piston engine is also provided with quick-closing non-return valves, such as the non-return valve 19, and the residual oil volume in the first chamber 12 on the outer dead centre of the piston 9 is kept to a minimum. These known measures are necessary in order to reduce the rebound to a minimum.

Figure 2:
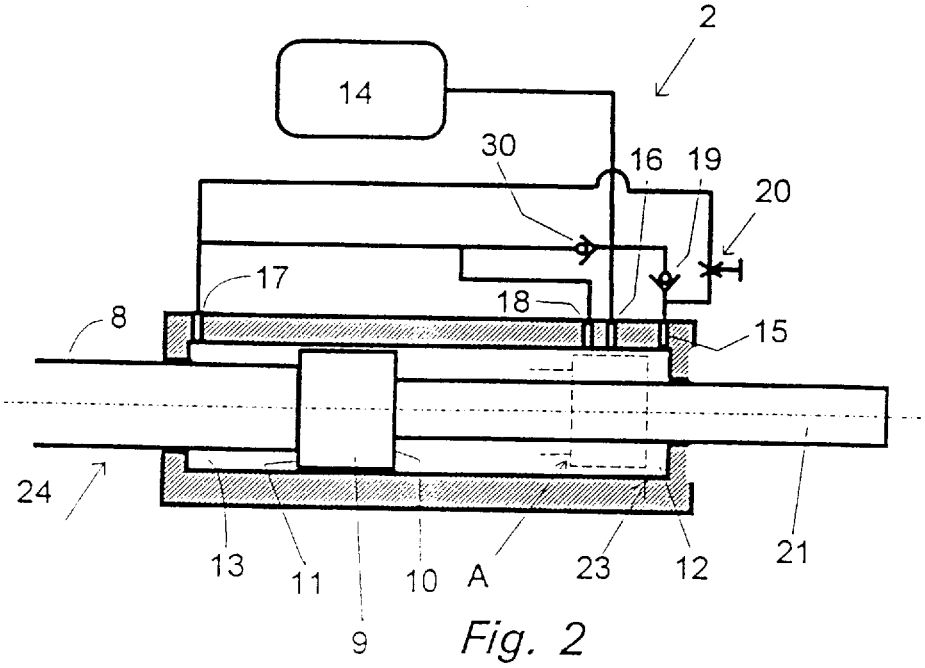
FIG. 2 shows a schematic section of a first embodiment of the hydraulic control system of the free-piston engine according to the invention.

FIG. 2 shows a first embodiment of the hydraulic control system 2, in which adjustments have been made, as a result of which the piston assembly 24 has a smaller rebound at the end of the expansion stroke. The rebound is caused by the fact that, in the embodiment according to FIG. 1, the pressure reigning in the first chamber 12 corresponds to the pressure in the pressure accumulator 14 at the end of the expansion stroke. Since the first surface 10 is larger than the second surface 11, on which the same pressure is exerted, the piston assembly 24 will move towards the combustion space and will then, as it were, rebound until the balance is restored.

In the embodiment according to FIG. 2, this movement is additionally slowed down by the increase in pressure in the second chamber 13 beyond the accumulator pressure. This increase results from the fact that the oil supply from the pressure accumulator 14 to the second chamber 13 via the channel 17 takes place via a return valve 30; the return valve 30 prevents the oil from flowing to the pressure accumulator 14 during the rebound. For a proper operation, this closing time preferably is as short as possible.

The open connection between the first and the second chamber via the channel 18, and hence the open connection between the pressure accumulator 14 and the second chamber 13, is closed by the hydraulic piston 9 when the piston assembly 24 is on the outer dead centre, the hydraulic piston then being in the first position A. In the first position A, the channel 17 and hence the second chamber 13, exclusively communicate with the channel 15 and the first chamber 12 via the starting valve 20.

After the piston assembly 24 has come to a standstill at the end of the expansion stroke, and when the rebound starts, the oil in the second space 13 cannot leave this space 13 when the starting valve 20 is closed, as a result of which the pressure in this space 13 rises owing to the movement of the piston 9, the rebound movement comes to a halt more quickly and the direction of movement is reversed. As a result of this movement, the pressure in the first chamber 12 rises beyond the pressure in the pressure accumulator 14 again, and the non-return valve 19 opens briefly.

The rebound is now repeated at a lower pressure and speed level, because energy has been drained off to the pressure accumulator 14 via the valve 19. These movements will be repeated until, partly owing to friction and leakage losses, the energy has been drained off and the piston 9 stands still. Due to the fact that the pressure in the space 13 can rise beyond the accumulator pressure, the movements of the piston assembly 24 during the rebound have a smaller range and lower speeds. As a result of this, a more accurate engine control is achieved.

In this embodiment, all the oil that is pushed out of the second chamber 13 by the hydraulic piston 9 is transferred to the first chamber 12 via the starting valve 20 at the start of the compression stroke. After the hydraulic valve 9 has passed the channel 18, there is an open connection between the first chamber 12 and the second chamber 13 by way of the channels 17 and 18. During the part of the compression and expansion strokes in which the piston speed is at a maximum, the oil can flow from the first to the second chamber with little resistance, as a result of which losses are kept to a minimum and the hydraulic efficiency remains high.

The position of the channel 16 in relation to the edge of the hydraulic piston 9 in the first position A meets the same demands as those discussed with reference to FIG. 1; as a result of the reduced rebound, an unintentional start of a stroke is less likely to take place. The operation of the starting valve and the other parts are also similar.

Figure 3:
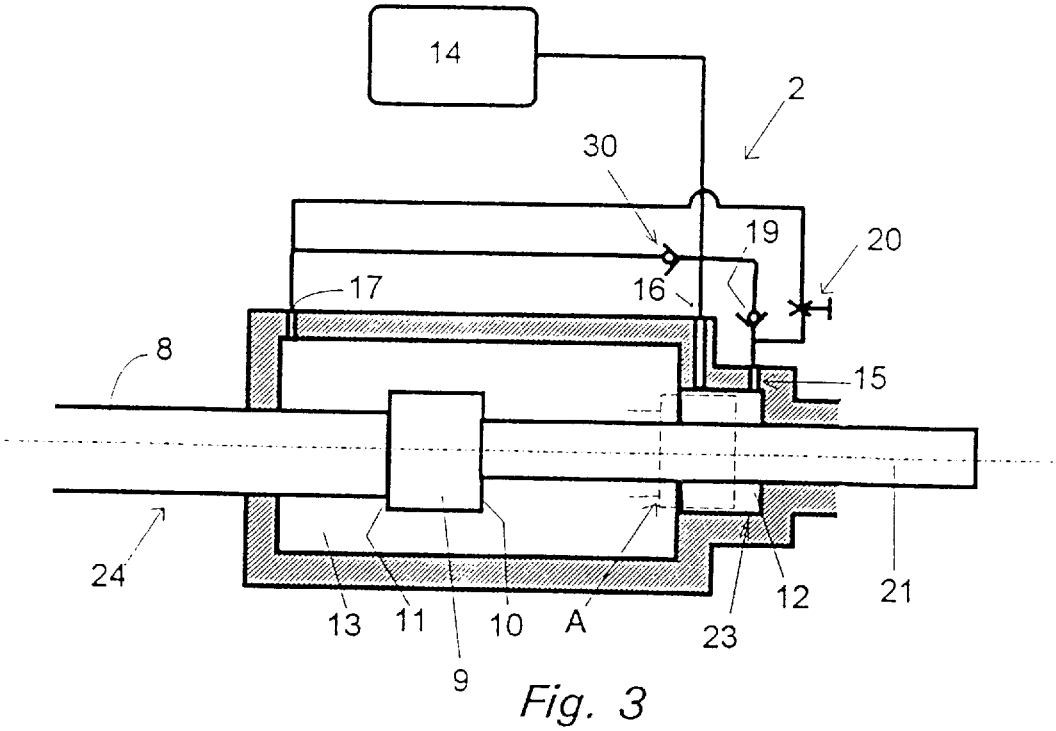
FIG. 3 shows a schematic section of a second embodiment of the hydraulic control system of the free-piston engine according to the invention, corresponding to FIG. 2.

FIG. 3 shows a second embodiment of the hydraulic control system 2.

The piston 9 is sealingly enclosed by the hydraulic cylinder 23 only in the vicinity of the outer dead centre, which is indicated in FIG. 3 as the first position A. In the first position A and with the starting valve 20 closed, the second chamber 13 communicates with the pressure accumulator 14 only via the return valve 30. In this position, the first chamber 12 is connected to the second chamber 13 by way of the channel 15 and the closed starting valve 20.

The compression stroke starts with the opening of the starting valve 20; the oil flows from the pressure accumulator 14, via the non-return valve 30 and the starting valve 20, to the first chamber 12, while the oil pushed out of the second chamber 13 by the piston 9 flows to the first chamber 12 via the channel 17, the starting valve 20 and the channel 15. The piston assembly 24 starts to move in the direction of the combustion chamber due to the accumulator pressure on the surface 10 and clears the channel 16 in the hydraulic cylinder 23. Until that moment, only the oil pushed out of the second chamber 13 by the hydraulic piston 9 flowed to the first chamber 12 via the starting valve 20. When the piston clears the hydraulic cylinder 23, only one oil chamber remains, with an open connection between this oil chamber and the pressure accumulator 14.

During the compression stroke, the piston assembly 24 moves in the direction of the combustion chamber, stops on the inner dead centre and starts the expansion stroke. During the expansion stroke, the oil pushed away by the hydraulic piston 9 is pushed with little resistance to the pressure accumulator 14 and during this movement the starting valve 20 closes. From the moment the hydraulic piston 9 is enclosed by the hydraulic cylinder 23, the oil that has been pushed away flows to the second chamber 13 via the non-return valve 30 and the channel 17. The oil then flows from the first chamber 12, via the channel 16, to the accumulator 14, and after the opening of the channel 16 is closed by the hydraulic piston 9, via the channel 15 and the non-return valve 19. The piston assembly is brought to a standstill in a similar way as has been described with reference to FIG. 2.

Figure 4:
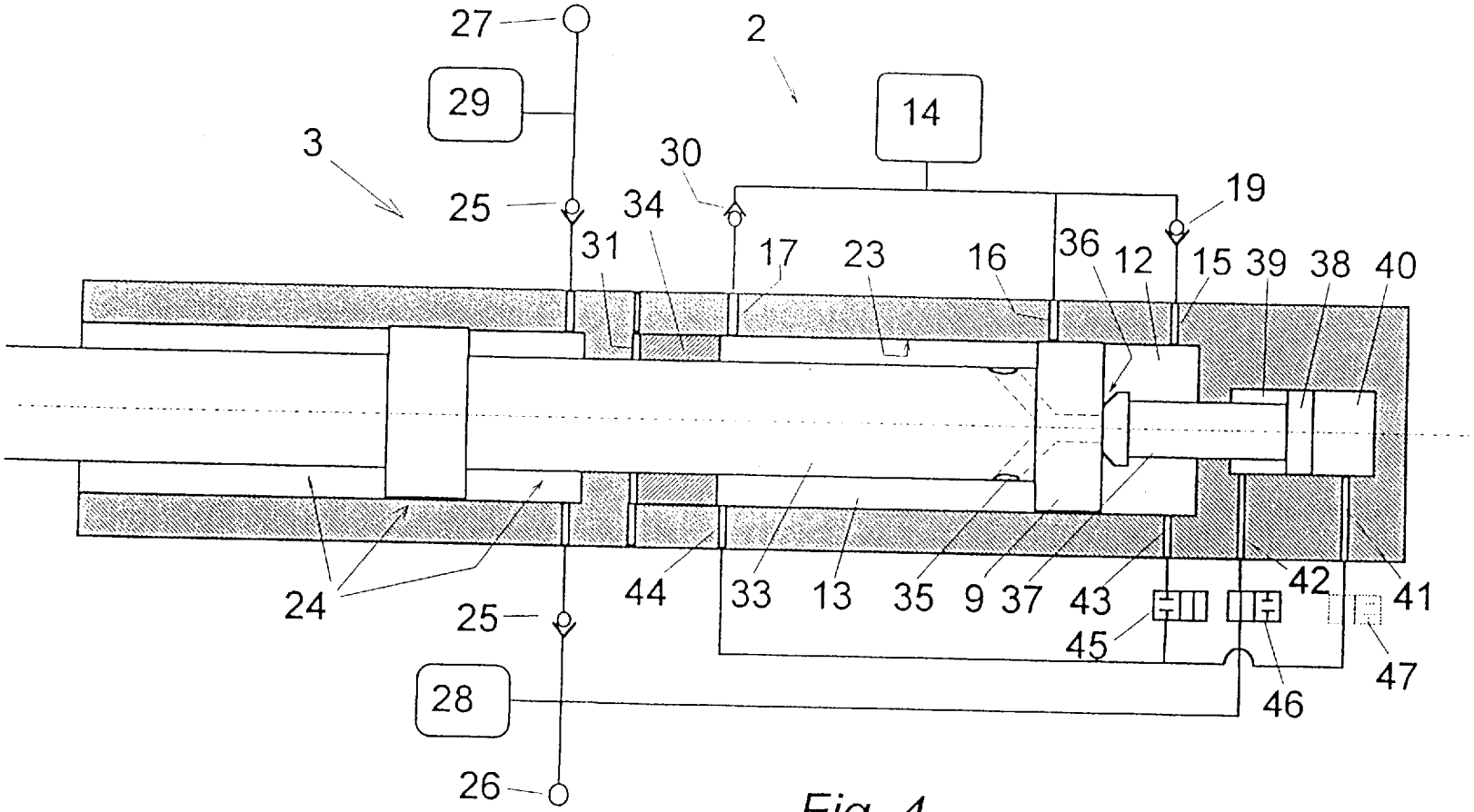
FIG. 4 shows, at a larger scale, a schematic section of a third embodiment of the hydraulic control system and the energy consumption system of the free-piston engine according to the invention.

FIG. 4 shows a schematic representation of a third embodiment, in which a quick-opening starting valve is integrally associated with some parts of the hydraulic control system 2.

A piston rod 33, to which a hydraulic piston 9 is attached, comprises a channel 35 connecting both sides of the hydraulic piston 9. On the side of the first chamber 12, this channel 35 can be closed at a valve seat 36 by means of a slidable valve body 37, and on the side of the second chamber 13 this can be achieved by means of a slidable ring 34, which can close the openings of the channel 35.

When the ring 34 is moved in the direction of the hydraulic piston 9, a space 31 is created. This space 31 can be connected by means of valves (not shown) to a point of high pressure as well as to a point of low pressure. As a result of this, the ring 34 is shifted in the hydraulic cylinder 23, allowing the piston assembly 24 to be taken to the outer dead centre. After the piston assembly 24 has been taken to the outer dead centre, the ring 34 can be moved to its starting position on the far left before the start of the next compression stroke.

The movements of the valve body 37 can be controlled by means of a valve piston 38, which, together with a cylinder, defines a first valve chamber 39 and a second valve chamber 40. The first valve chamber 39 communicates with a point of low pressure via the channel 42 and a valve 46. The second valve chamber 40 is in open communication with the second chamber via a channel 41 and a channel 44, and hence with the pressure reigning in the pressure accumulator 14. If desired, a valve 47 can be placed in this conduit, so that the valve 46 can be omitted. The first chamber 12 communicates via a channel 43, a valve 45 and the channel 44 with the second chamber. The diameter of the valve piston 38 is larger than the diameter of the seal at the valve seat 36.

The compression stroke of the engine which is equipped with the hydraulic control system shown in FIG. 4, starts by opening the valve 45. Consequently, the piston assembly 24 will start to move in the direction of the combustion space. Due to the pressure in the second valve chamber 40, the valve body 37 will have a tendency to follow this movement. However, owing to the fact that the valve 46 is closed at the same time as the valve 45 is opened, the valve body 37 does not move and a gap arises at the site of the valve seat 36, as a result of which the channel 35 opens. Then, oil flows through this channel 35 from the pressure accumulator 14, via the non-return valve 30, the channel 17 and the second chamber 13 to the first chamber 12, as a result of which the piston assembly 24 starts to move towards the combustion space, marking the beginning of the compression stroke.

After the compression stroke has started, the valve 45 is closed and the valve 46 is opened. Consequently, the valve body 37 moves towards the piston assembly 24 and is ready to close the channel 35 at the end of the expansion stroke. If desired, the valve 46 is replaced by the valve 47, resulting in a similar operation. The oil flow generated by the movement of the piston assembly 24 passes the valve seat 36 and moves through the channel 35, so that the valves 45, 46 and 47 can be given a very small size, and thus are able to switch quickly. The starting valve 20 in the FIGS. 1–3 has thus been replaced by the valve body 37 which closes the channel 35, which moves under oil pressure and which is controlled by means of the valves 45, 46 or 47.

At the end of the expansion stroke, the piston assembly 24 comes to a standstill as a result of the channel 35 being closed by the valve body 37. The pressure in the second valve chamber 40 equals the pressure in the second chamber 13, as a result of which the valve body 37 remains sealingly pressed against the valve seat 36, even during the rebound and the resulting pressure increase in this chamber. The valve seat 36 may be provided with means for improving the seal. The valve seat 36 may, for example, be made of elastic material, or the conical part may be provided with an elastic layer.

We claim:

1. A free-piston engine, comprising a combustion part (1), a hydraulic control system (2), an energy consumption system (3) and an engine control system, said combustion part (1) comprising, among other parts, a combustion cylinder (5) with at least one combustion piston (4), which defines one side of a combustion space (6) and which is reciprocatable in the combustion cylinder (5) between a first position (A) in which the volume of the combustion space (6) is at a maximum, and a second position in which this volume is at a minimum, said hydraulic control system (2) serving, among other functions, to supply the energy required for compression of the combustion air to the combustion piston (4) during a compression stroke, which coincides with the movement from the first position (A) to the second position, to drain off part of the energy released in combustion during an expansion stroke, which coincides with the movement of the second to the first position, and that to store this energy in a pressure accumulator (14), and which also allows the combustion piston (4) to stand still in the first position (A), said hydraulic control system (2) comprising, among other parts, a hydraulic piston (9) which, together with a combustion piston (4), forms a piston assembly (24), and which has a first surface (10) that, when under hydraulic pressure, exerts a force on the piston assembly (24) that is directed towards the combustion space (6), and a second surface (11), smaller than the first surface (10), that, when under hydraulic pressure, exerts a force on the piston assembly (24) that is directed away from the combustion space (6), a hydraulic cylinder (23) into which the hydraulic piston (9) at least near the first position (A) sealingly fits, a starting valve (20; 37, 45, 46) provided in a first channel between a first chamber (12), which is defined by the first surface (10) and the hydraulic cylinder (23) in the first position (A) of the piston assembly (24), and a second chamber (13), which is defined by the second surface (11) of the hydraulic piston (9) and the hydraulic cylinder (23), and a second channel through which oil can flow from the pressure accumulator (14) to the second chamber (13), in which the first chamber (12) can be provided with oil in the first position (A) via the first channel by merely opening the starting valve (20; 37, 45, 46), characterized in that a non-return valve (30) is provided in the second channel between the second chamber (13) and the pressure accumulator (14).

2. A free-piston engine according to claim 1, characterized by a third channel (16) which is closed in and near the first position (A) and which provides an open connection between the first chamber (12) and the pressure accumulator (14) during the remaining part of the stroke.

3. A free-piston engine according to claim 1, characterized by a channel (17; 18; 35;) which is closed in and near the first position (A) and which provides an open connection between the first (12) and the second (13) chamber during the remaining part of the stroke of the hydraulic piston (9).

4. A free-piston engine according to claim 2, characterized by a channel (17; 18; 35;) which is closed in and near the first position (A) and which provides an open connection between the first (12) and the second (13) chamber during the remaining part of the stroke of the hydraulic piston (9).

* * * * *